United States Patent [19]

Burkes

[11] Patent Number: 4,488,748

[45] Date of Patent: Dec. 18, 1984

[54] SKI/POLE CARRIER APPARATUS

[76] Inventor: Marc Burkes, 4605 Alexander Dr., Metairie, La. 70003

[21] Appl. No.: 376,531

[22] Filed: May 10, 1982

[51] Int. Cl.[3] ..... A63C 11/02

[52] U.S. Cl. ..... 294/147; 294/154; 294/157; 294/170

[58] Field of Search ..... 294/31.2, 74, 137, 141–143, 294/146–154, 156, 157, 162–167, 170, 171; 224/DIG. 917; 280/814

[56] References Cited

U.S. PATENT DOCUMENTS 736,632 8/1903 Priddat ..... 294/171
743,945 11/1903 Soden ..... 294/171

FOREIGN PATENT DOCUMENTS 2501996 9/1975 Fed. Rep. of Germany ..... 294/147

*Primary Examiner*—Johnny D. Cherry
*Attorney, Agent, or Firm*—Thomas S. Keaty

[57] ABSTRACT

An adjustable ski carrier having a flexible rope with two snap locks on each end. A handle provided on the rope has inwardly extending slots on each end of the handle. A pair of spaced apart apertures made on the opposite side of the handle are adapted to receive the rope from within a handle and extended over the top of the handle on the outside of it. A distance between the apertures is smaller than the distance between the most inward ends of the slots. The length of the rope in relation to the snap locks can be adjusted by extending the loop created by the part of the rope lying atop of the handle so that the device can be used for carrying the skis up the slope or down the slope in a balanced manner, and with the handle being fixed in a certain position by means of the slots in combination with the apertures and the loop. A knot created atop of the handle from the loop can be used to further ensure a fixed distance between the handle and the snap locks on the ends of the rope.

2 Claims, 5 Drawing Figures

SKI/POLE CARRIER APPARATUS

BACKGROUND OF THE INVENTION

1. Field of the Invention

The present invention relates to a novel ski/pole carrier apparatus. This apparatus can be placed in one's pocket with ease and can be connected to the ski/poles without difficulty and with gloves on.

2. General Background

For many years a multitude of different types of ski/-pole carrying devices have been available to facilitate carrying skis and poles. The present invention markedly improves the state of the art by providing an apparatus, which can be placed in one's pocket with ease and which can be connected to the ski/poles without difficulty and with gloves on. Not only is the present invention compact and easy to use, but it also is inexpensive. The apparatus can also be positioned for uphill carry as well as downhill carry and/or shoulder carriage.

The apparatus consists of a plastic, or any other suitable material, tubular handle through which is passed a rope. A conventional swivel, snap hook is mounted to each end of the rope. One end of the rope is then wrapped around the skis and poles directly in front of the front binding and the snap hook is hooked to the other part of the rope directly above the skis and poles so as to secure same. The other end of the rope is looped around the skis and poles directly behind the rear binding and the snap hook is hooked to the other part of the rope directly above the skis and poles so as to secure same. The user then firmly grasps the handle with one hand and carries the skis and poles. Alternatively, the user can position the apparatus on his shoulders for shoulder carriage, as the height of the rope can be easily adjusted.

These objects, as well as others, will be fulfilled in the following description and claims, taken in conjunction with the attached drawings.

DETAILED DESCRIPTION OF THE PREFERRED EMBODIMENT

Figure 1:
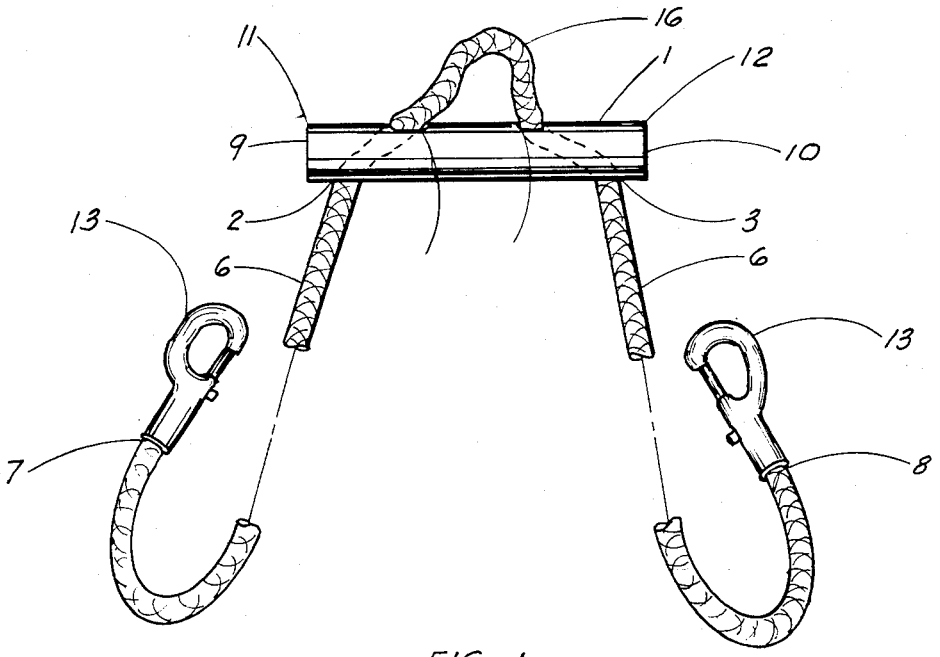
FIG. 1 is an elevated, frontal view of the present invention.
Figure 4:
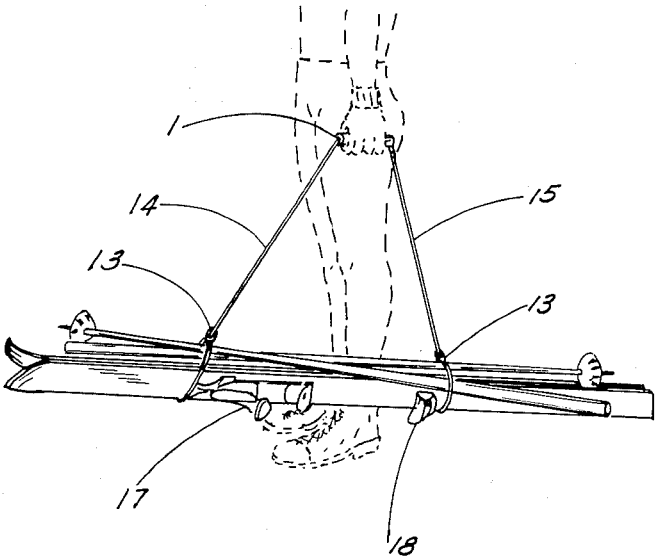
FIG. 4 depicts the invention in conventional use wth the user hand-carrying it.
Figure 2:
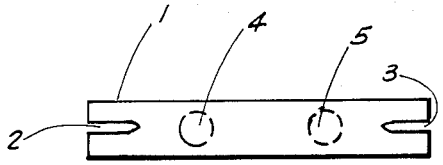
FIG. 2 is a bottom view, in perspective, of the tubular handle.
Figure 3:
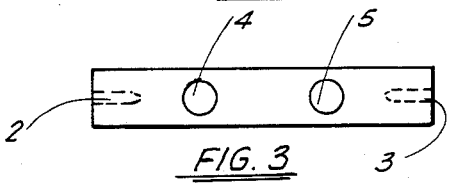
FIG. 3 is a top view, in perspective, of the tubular handle.

Referring to the drawings, there can be seen in FIG. 1 an elongated, hollow, plastic, or any other suitable material, tubular handle 1. As seen in FIG. 2, a short slot 2, 3 is cut into the bottom surface of the handle 1 from each outer end thereof. Two small apertures 4, 5 of a larger diameter than that of the rope 6 (hereinafter described) are provided on the top surface of the handle 1, near the center thereof, the apertures 4, 5 being positioned in a spaced, linear relationship to each other, each one being equidistant from the other edges of the handle 1, as seen in FIG. 3.

Figure 5:
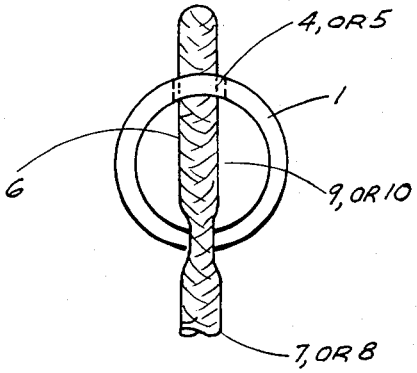
FIG. 5 is a partly sectional, side view of the handle with the rope passing therethrough.

A conventioned nylon, or any other suitable material, flexible rope 6 of a smaller diameter than that of the apertures 4, 5 provided on the top surface of the handle 1, is another aspect of the present invention. One end 7 of the rope 6 is passed through one of the apertures 4 and the other end 8 of the rope 6 is passed through the other aperture 5. One end 7 of the rope 6 is then passed through the opening 9 at one outer end 11 of the hollow handle 1, and the other end 8 of the rope 6 is then passed through the opening 10 at the other outer end 12 of the hollow handle 1, as seen in FIG. 5. Each strand 14, 15 of the now bifurcated rope 6, is firmly positioned in the slots 2, 3, respectively. The ends 7, 8 of the rope 6 are each tied to a conventional swivel snap hook 13.

The above-described apparatus of the present invention is operated in the following simple manner:

1. The distance between the handle and the skis is adjusted by means of outwardly pulling each strand 14, 15 of the rope 6 on both sides of the handle 1, from the slots 2, 3 in which each one is respectively firmly positioned, and pulling upward or downward on the part of the rope 6 extending through the apertures 4, 5 of the handle 1 until the desired height is achieved. Except when the maximum height is desired, a loop 16 will be formed by the rope 6 between the two apertures 4, 5 provided on the top surface of the handle 1 and the loop 16 can be tied into a simple knot, so as to prevent slippage. Each strand 14, 15 of the rope 6 is then firmly positioned back into the slots 2, 3, respectively, of the handle 1.

2. One end 7 of the rope 6 is looped around the skis and poles (the ski boots can be placed in the bindings) directly in front of the front binding 17 and the snap hook 13 is snapped onto the other part of the rope directly above the skis and poles so as to complete the loop, thereby securing the skis and poles. The other end 8 of the rope 6 is looped around the skis and poles directly behind the rear binding 18 and the snap hook 13 is snapped onto the other part of the rope 6 directly above the skis and poles so as to complete the loop and secure the skis and poles.

3. The user then firmly grips the handle 1 with one of his hands and carries the skis and poles (and/or boots). The user can pull the handle 1 upward for uphill carry, or push the handle downward for downhill caarry. Alternatively, the apparatus can be placed on one's shoulder, assuming the height adjustment has already been made in the manner described in (1) above.

4. When the user wishes to use the skis and poles, he merely sets the handle 1 and skis and poles on the ground and unsnaps both snap hooks 13, thereby freeing the skis and poles for use.

5. The user then puts the apparatus into his pocket or any other suitable and convenient place until further use.

Various other objects and advantages of this invention will become readily apparent to those skilled in the art upon reading the following claims.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A ski carrier apparatus, comprising:

a. a flexible rope having a lock means at each end thereof;

b. an elongated tubular handle provided with:

i. longitudinal slots on a bottom portion at opposite ends of said handle, said handle being adapted to receive said rope from its opposite open ends, and said slots being adapted to secure said rope within said handle;

ii. a pair of linearly spaced apart apertures on an upper side of said handle equidistantly located from the center of said handle, a distance between said apertures being less than a distance between the innermost ends of said slots, said apertures being adapted to receive said rope from within said handle, so that said rope extends upwardly from said handle and forms a loop above the top side of said handle, the minimum length of said loop being the distance between said apertures.

2. The apparatus of claim 1, wherein the distance between said handle and said lock means is adjusted by enlarging said loop atop said handle.

* * * * *